US008137132B2

(12) United States Patent
Lu

(10) Patent No.: US 8,137,132 B2
(45) Date of Patent: Mar. 20, 2012

(54) ELECTRICAL SIGNAL CONNECTOR PROVIDING A PROPER INSTALLATION OF A CABLE

(76) Inventor: Yueh-Chiung Lu, Tao-Yuan County (TW)

( * ) Notice: Subject to any disclaimer, the term of this patent is extended or adjusted under 35 U.S.C. 154(b) by 0 days.

(21) Appl. No.: 12/888,984

(22) Filed: Sep. 23, 2010

(65) Prior Publication Data

US 2011/0201231 A1 Aug. 18, 2011

(30) Foreign Application Priority Data

Feb. 12, 2010 (TW) ..... 99203163 U

(51) Int. Cl.
*H01R 9/05* (2006.01)

(52) U.S. Cl. ..... 439/578

(58) Field of Classification Search ..... 439/578, 439/580, 582, 583, 584, 585, 587, 588, 589
See application file for complete search history.

(56) References Cited

U.S. PATENT DOCUMENTS

| | | | | |
|---|---|---|---|---|
| 5,338,225 | A * | 8/1994 | Jacobsen et al. | 439/585 |
| 5,470,257 | A | 11/1995 | Szegda | |
| 6,089,912 | A * | 7/2000 | Tallis et al. | 439/584 |
| 6,210,222 | B1 * | 4/2001 | Langham et al. | 439/583 |
| 6,425,782 | B1 * | 7/2002 | Holland | 439/585 |
| 6,716,062 | B1 * | 4/2004 | Palinkas et al. | 439/578 |
| 6,733,336 | B1 * | 5/2004 | Montena et al. | 439/578 |
| 6,733,338 | B1 * | 5/2004 | Hsia | 439/578 |
| 6,790,083 | B1 * | 9/2004 | Chen | 439/583 |
| 6,805,584 | B1 * | 10/2004 | Chen | 439/578 |
| 6,848,940 | B2 * | 2/2005 | Montena | 439/584 |
| 6,960,101 | B1 * | 11/2005 | Chen | 439/578 |
| 7,063,565 | B2 * | 6/2006 | Ward | 439/578 |
| 7,252,546 | B1 * | 8/2007 | Holland | 439/584 |
| 7,255,598 | B2 * | 8/2007 | Montena et al. | 439/578 |
| 7,288,002 | B2 * | 10/2007 | Rodrigues et al. | 439/578 |
| 7,410,389 | B2 * | 8/2008 | Holliday | 439/578 |
| 7,452,237 | B1 * | 11/2008 | Montena | 439/578 |
| 7,458,849 | B2 * | 12/2008 | Rodrigues et al. | 439/578 |
| 7,566,236 | B2 * | 7/2009 | Malloy et al. | 439/321 |
| 7,794,275 | B2 * | 9/2010 | Rodrigues | 439/584 |
| 7,841,896 | B2 * | 11/2010 | Shaw et al. | 439/578 |
| 7,892,005 | B2 * | 2/2011 | Haube | 439/321 |
| 2004/0102089 | A1 * | 5/2004 | Chee | 439/578 |
| 2004/0229504 | A1 * | 11/2004 | Liu | 439/578 |
| 2006/0110977 | A1 * | 5/2006 | Matthews | 439/578 |

FOREIGN PATENT DOCUMENTS

| | | |
|---|---|---|
| TW | M255573 | 1/2005 |

* cited by examiner

*Primary Examiner* — Tulsidas C Patel
*Assistant Examiner* — Vladimir Imas
(74) *Attorney, Agent, or Firm* — Muncy, Geissler, Olds & Lowe, PLLC

(57) ABSTRACT

An electrical connector includes a metal locknut having an inner thread, an orifice defined and a retaining portion, an elastic cylindrical casing having a mounting base for fastening to the retaining portion of the locknut, a core tube inserted into the locknut and the cylindrical casing for receiving the center conductor and inner dielectric insulator of a coaxial cable and having a barbed flange for engaging the braided metal wrapper of the coaxial cable, a first tubular wall and a packing portion connected for engaging into the mounting base of the cylindrical casing, and a barrel mounted on the cylindrical casing and having a contracted inner wall portion adapted for compressing the cylindrical casing.

4 Claims, 13 Drawing Sheets

ELECTRICAL SIGNAL CONNECTOR PROVIDING A PROPER INSTALLATION OF A CABLE

This application claims the priority benefit of Taiwan patent application number 099203163 filed on Feb. 12, 2010.

BACKGROUND OF THE INVENTION

1. Field of the Invention

The present invention relates an improved structure of electrical signal connector and more particularly, to such an electrical signal connector, which facilitates alignment, insertion and installation of a mating cable. Subject to the characteristic that the barbed flange of the core tube is suspending in the cylindrical casing near the end edge of the tubular body, the invention facilitates mounting of a mating cable without causing damage to the aluminum foil shield of the mating cable.

2. Description of the Related Art

Following fast development of communication technology, signal transmission requires high stability and rapid speed. In consequence, different communication wire materials, from the early flat cable design to the modern round cable and optical cable designs, have been created to enhance signal transmission speed and capacity. Subject to the application of telephone technology, video technology and internet technology, global communication becomes faster and cheaper. Transmission of video signal through a cable assures signal stability and reliability. Therefore, closed-circuit TV is developed after the application of wireless TV and satellite TV. Establishing a closed-circuit television system requires installation of cables between the provider and the subscribers. When a cable is extended to a house, an electrical signal connector must be used to connect the cable to an indoor electric or electronic device. A conventional electrical signal connector A for this purpose, as shown in FIGS. 9~11, comprises a casing A1 having a seam line A11, and a crimping tube A2, which is forced into the casing A1 by a tool to secure the inserted cable B to the casing A1. However, if the crimping tube A2 is not kept in alignment with the seam line A11 during installation, the crimping tube A2 may break. Further, when the cable B is stretched accidentally, the center conductor B1 of the cable B may be forced out of position, causing a poor contact and signal transmission instability. Further, the crimping tube A2 must be sleeved onto the cable B before insertion of the cable B into the casing A1. This installation procedure is inconvenient.

Taiwan utility number M255573, application series number 93200319, issued on Jan. 11, 2005, discloses an electrical signal connector C, as shown in FIG. 12. According to this design, the electrical signal connector C comprises a locknut C1 having a coupling flange C11, a sleeve C2 having a coupling groove C21 coupled to the coupling flange C11 of the locknut C11, a bushing C3 inserted into the axial hole C20 of the sleeve C2 and having a stepped flange C31, and a core tube C4 mounted in the bushing C3 and having a coupling portion C41 abutted against the stepped flange C31 of the bushing C3. The installation of this design of electrical signal connector requires the use of a hand tool. When connecting the electrical signal connector to a connector at an electronic device, the core tube C4 and the bushing C3 are forced into engagement with each other and movable in the axial hole C20 of the sleeve C2. According to this design, the locknut C1 of the electrical signal connector C has a big size and high manufacturing cost, and can only be rotated by hand without tool. Fastening the locknut C1 by hand cannot achieve high connection tightness. Further, the end edge C42 of the core tube C4 is spaced from the outer end C22 of the sleeve C2 at a distance. The user cannot see the position of the end edge C42 of the core tube C4 during installation of a cable, complicating the installation.

FIG. 13 illustrates another electrical signal connector according to the prior art. This design is substantially similar to the design shown in FIG. 12 with the exception that a spring member C5 is set between the coupling flange C11 of the locknut C1 and the outer wall C32 of the stepped flange C31 of the bushing C3 to impart a pressure to the bushing C3 and the core tube C4 in direction away from the locknut C1 so that the end edge C42 of the core tube C4 can be kept close to the outer end C22 of the sleeve C2 to facilitate alignment and installation of the cable B. However, this design of electrical signal connector still has the drawbacks of numerous component parts, complicated manufacturing process and complicated installation procedure.

In view of the drawbacks of conventional electrical signal connectors, U.S. Pat. No. 5,470,257 discloses an improved electrical signal connector, entitled "radial compression type coaxial cable end connector". According to this design, as shown in FIG. 14, the radial compression type coaxial cable end connector has a connector body comprising a tubular inner post D2 extending from a front end to a rear end, and an outer collar D1 surrounding and fixed relative to the inner post D2 at a location disposed rearwardly of the front post end. The outer collar D1 cooperates in a radially spaced relationship with the inner post to define an annular chamber with a rear opening. A fastener D at the front end of the inner post D2 serves to attach the end connector to a system component. A tubular locking member E protrudes axially into the front open side D11 of the outer collar D1. The cable B is inserted from the outer end E1 of the tubular locking member E into the chamber E0 in the tubular locking member E and kept in alignment with the outer end D21 of the inner post D2, and then a hand tool is operated to move the tubular locking member E and the cable B into the chamber D10 in the outer collar D1,enabling the center conductor B1 and inner insulator B2 and aluminum foil shield B3 of the cable B to be engaged into the axial hole D20 of the inner post D2. In actual use, this design of radial compression type coaxial cable end connector still has drawbacks. For example, the outer end D21 of the inner post D2 is kept away from the outer end E1 of the tubular locking member E at a distance. During installation of the cable B, it is difficult to keep the center conductor B1 and inner insulator B2 and aluminum foil shield B3 of the cable B in alignment with the axial hole D20 of the inner post D2. After insertion of the cable B into the inner post D2, the center conductor B1 of the cable B may be deformed, and the aluminum foil shield B3 of the cable B may be damaged, causing signal transmission instability.

In order to eliminate the drawbacks of the aforesaid prior art designs, an improved coaxial cable connector is created. According to this design, as shown in FIG. 15, the coaxial cable connector comprises a locknut F, an outer tubular member F1 connected to the locknut F, an inner tubular member F2 mounted in the outer tubular member F1, a barrel G slidably coupled to the outer tubular member F1, and a guide tube F3 connected to the axial hole F20 of the inner tubular member F2. The guide tube F3 has an axial guide hole F30 defined therein and extending through front and rear ends thereof. The front end of the guide tube F3 extends to the front side G1 of the barrel G. Because the front end of the guide tube F3 is kept in flush with the front side G1 of the barrel G, the center conductor B1 of the cable B can be accurately inserted into the axial guide hole F30 of the guide tube F3, enabling the inner dielectric insulator B2 of the outer plastic sheath B to be stopped outside the guide tube F3. At this time, a hand tool is used to move the barrel G, the guide tube F3 and the cable B into the outer tubular member F1, enabling the guide tube F3 to pass out of the other end of the axial hole F20 of the inner tubular member F2, guiding the center conductor B1, inner dielectric insulator B2 and aluminum foil shield B3 of the outer plastic sheath B into the axial hole F20 of the inner tubular member F2. This design facilitates alignment of the cable during installation, however it still has drawbacks as follows:

1. This design of coaxial cable connector consists of a number of component parts, complicating installation. Further, the guide tube F3 must be thrown away after its service, not allowing for a repeated use. Waste of the guide tube relatively increases the connector cost.
2. The guide tube F3 must be made having a certain length so that the front end of the guide tube F3 can extend to the front side G1 of the barrel G. During insertion of the cable B, the long guide tube F3 tends to be vibrated, complicating alignment between the cable B and the axial hole F20 of the inner tubular member F2.

Therefore, it is desirable to provide an electrical signal connector, which facilitates quick and accurate connection of a coaxial cable without causing deformation of the center conductor of the coaxial cable or damage to the aluminum foil shield of the coaxial cable.

SUMMARY OF THE INVENTION

The present invention has been accomplished under the circumstances in view. It is the main object of the present invention to provide an electrical signal connector, which facilitates quick and accurate installation of a coaxial cable, without causing deformation of the coaxial cable or any damage to the aluminum foil shield of the coaxial cable. It is another object of the present invention to provide an electrical signal connector, which achieves excellent waterproof effects.

To achieve these and other objects of the present invention, an electrical signal connector comprises a locknut, a cylindrical casing fastened to one end of the locknut, a core tube inserted into the locknut and the cylindrical casing and a barrel mounted on the cylindrical casing. The locknut is made of metal. The cylindrical casing is made of an elastic material. The locknut comprises a retaining portion located on one end thereof. The cylindrical casing comprises a mounting base for fastening to the retaining portion of the locknut. The inner diameter of the retaining portion of the locknut is slightly smaller than the outer diameter of the mounting base of the cylindrical casing so that fastening the mounting base of the cylindrical casing to the retaining portion of the locknut causes a retaining portion of the mounting base of the cylindrical casing to be forced into engagement with a stepped shoulder of retaining portion of the locknut, and the stepped shoulder will be compressed to seal the gap upon between the cylindrical casing and the locknut and to prevent water leakage upon installation of an external matching electrical connector. After mounting of the barrel on the cylindrical casing, a part of the cylindrical casing is compressed by the barrel to form a neck portion, facilitating quick and accurate installation of a coaxial cable.

Further, after insertion of the core tube into the locknut and the cylindrical casing, the core tube can be moved axially relative to the locknut and the cylindrical casing before installation of a coaxial cable, and a packing portion of the core tube is forced into engagement with a mounting hole in the cylindrical casing to secure the core tube to the locknut and the cylindrical casing firmly in position after installation of a coaxial cable in the electrical signal connector. Further, after installation of the barrel in the cylindrical casing, a hooked portion of the barrel engages the periphery of the tubular body of the cylindrical casing, and the tubular body of the cylindrical casing is compressed by a tapered inner surface portion and contracted inner wall portion of the barrel to deform, forming the desired neck portion. When inserting a coaxial cable into the core tube, the applied thrust force will force a packing portion of the core tube away from the peripheral wall of a mounting hole in the cylindrical casing, allowing axial movement of the core tube in the mounting hole of the cylindrical casing and insertion of the copper core (center conductor), aluminum foil shield and inner dielectric insulator of the coaxial cable into the core tube. Thereafter, the core tube is pushed back to force the packing portion into the mounting hole of the cylindrical casing, causing the braided metal wrapper (woven copper shield) surrounded and outer plastic sheath of the coaxial cable to be stopped in place by the neck portion of the cylindrical casing, and therefore the neck portion secures the coaxial cable in place, assuring connection stability and avoiding disconnection of the coaxial cable from the cylindrical casing.

DETAILED DESCRIPTION OF THE PREFERRED EMBODIMENT

Figure 1:
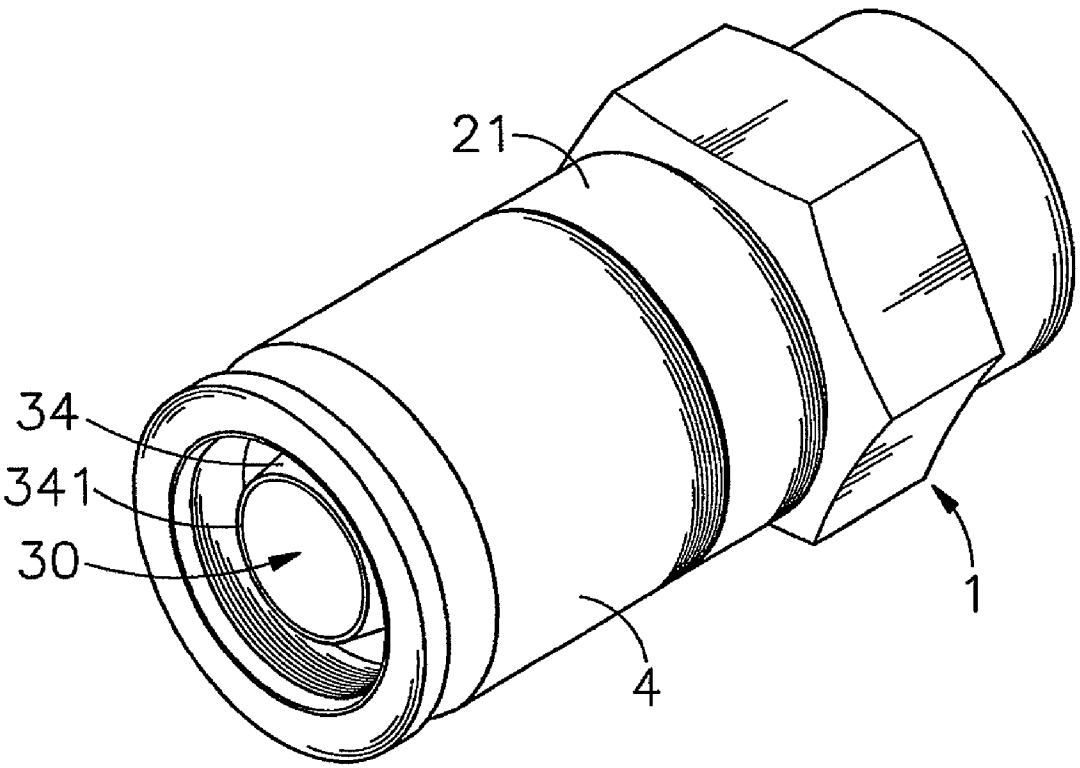
FIG. 1 is an elevational view of an electrical signal connector in accordance with the present invention.
Figure 2:
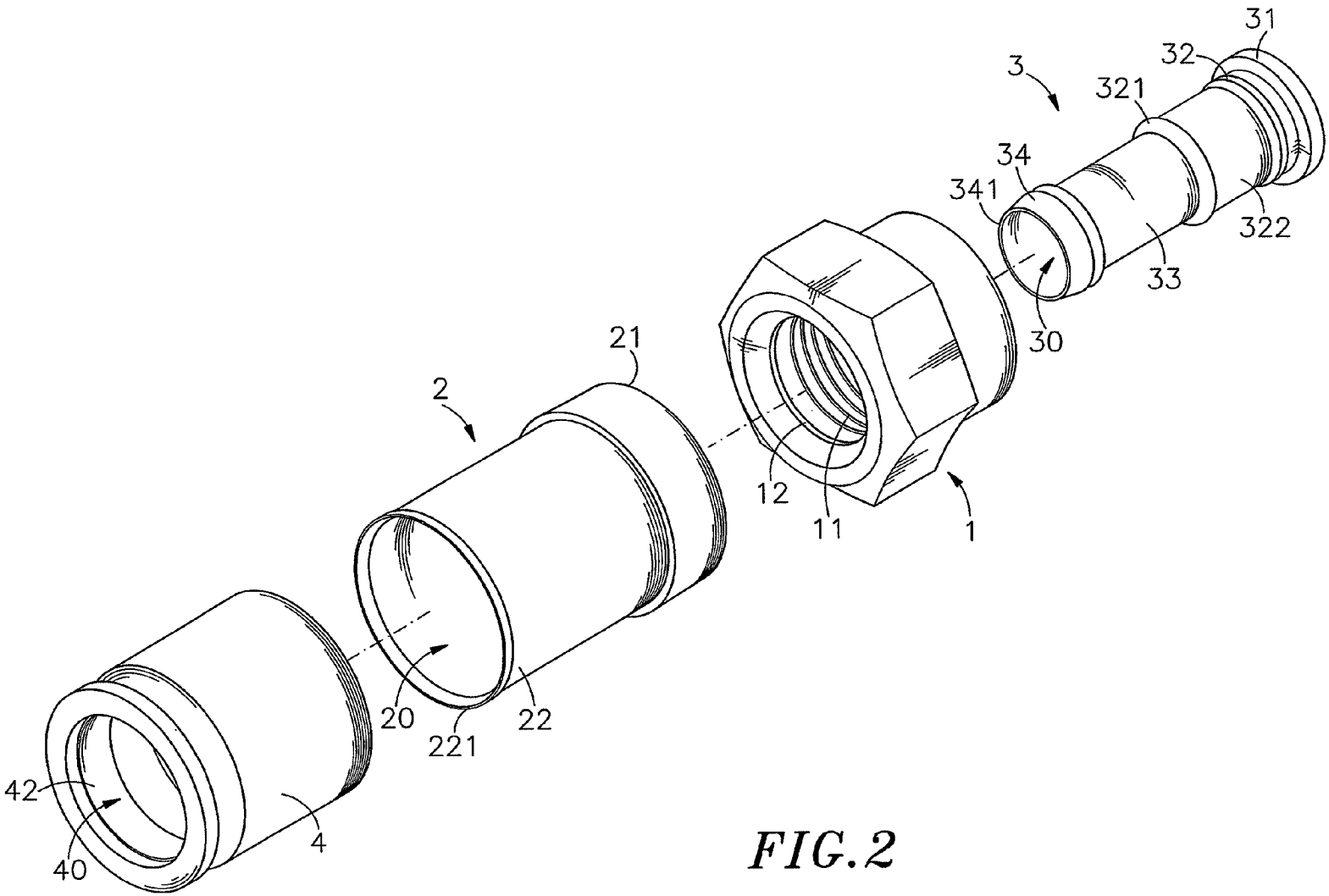
FIG. 2 is an exploded view of the electrical signal connector in accordance with the present invention.
Figure 3:
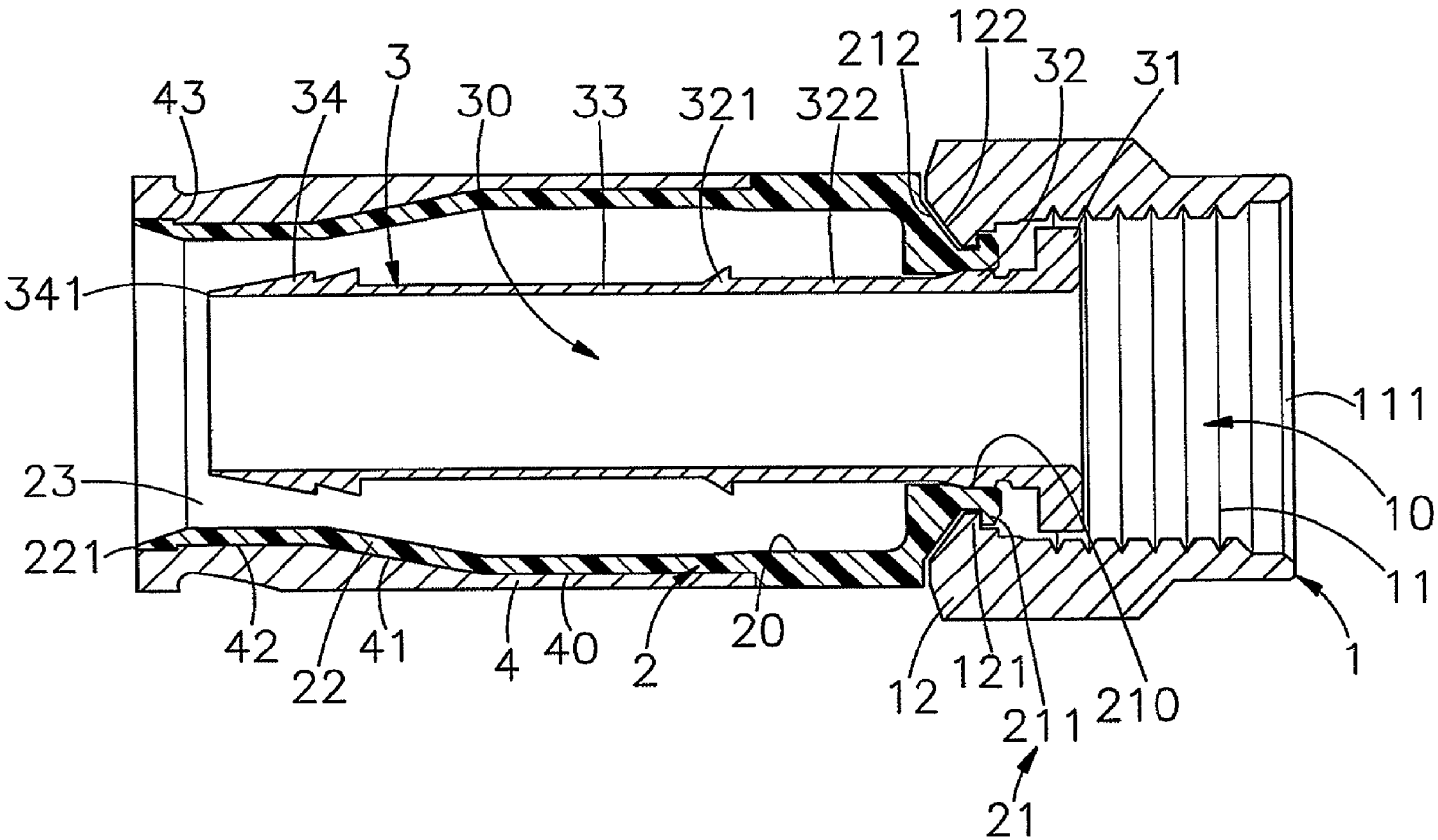
FIG. 3 is a sectional assembly view of the electrical signal connector in accordance with the present invention.
Figure 4:
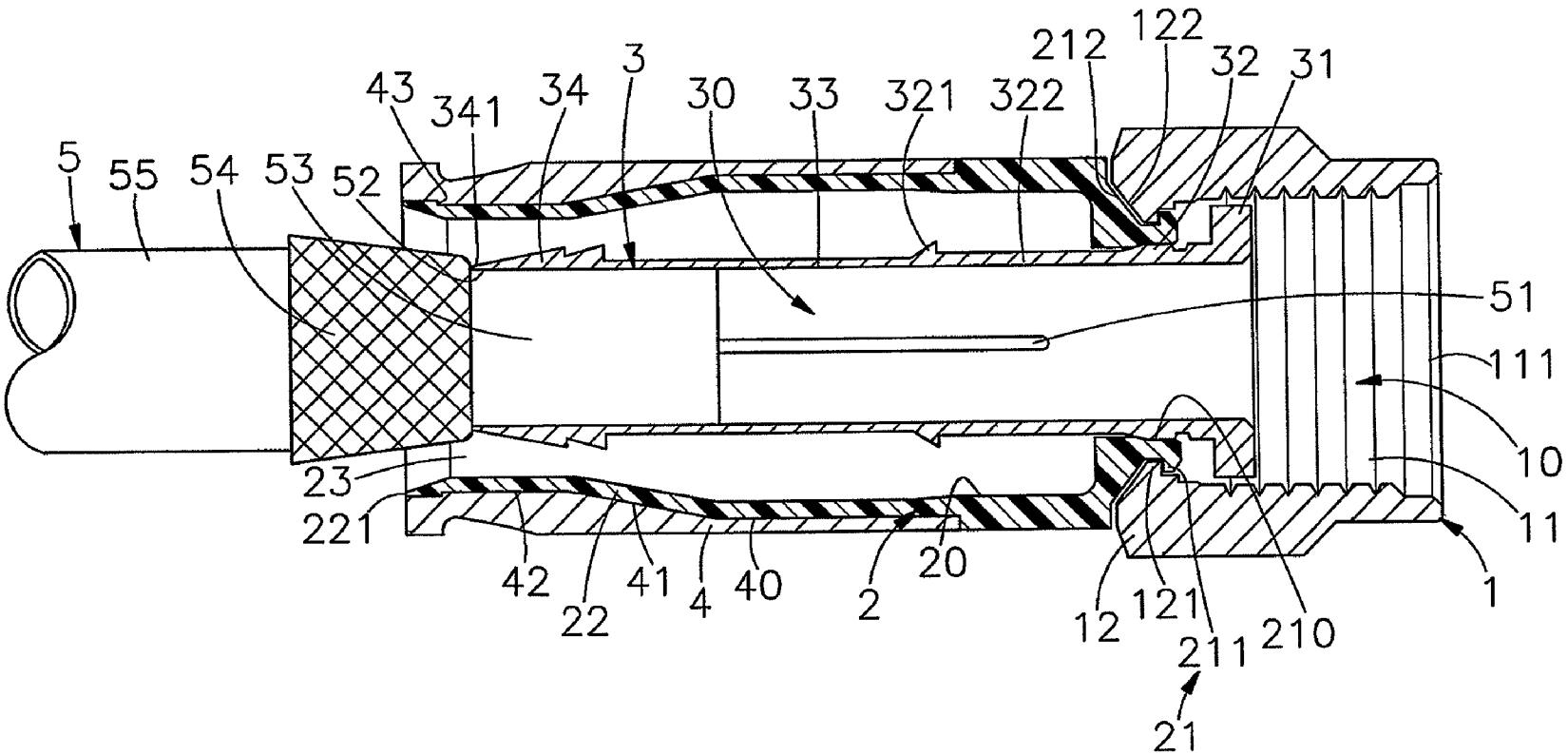
FIG. 4 is a schematic sectional view of the present invention, illustrating a coaxial cable inserted into the electrical signal connector.

Referring to FIGS. 1~4, an electrical signal connector in accordance with the present invention is shown comprising a locknut 1, a cylindrical casing 2, a core tube 3 and a barrel 4.

The locknut 1 is a metal member shaped like a polygonal screw nut, having a center hole 10 axially extending through opposing front and rear sides thereof, an inner thread 11 extending around the inside wall within the center hole 10, an orifice 111 defined in the rear side in communication with one end of the center hole 10, and a retaining portion 12 located on the front side around the center hole 10. The retaining portion 12 comprises a stepped shoulder 121 extending around the other end of the center hole 10 and a beveled abutment face 122 located on the outer side of the stepped shoulder 121. Further, the locknut 1 can be made of copper, ferrite, or any of a variety of metal alloys.

The cylindrical casing 2 is made of an elastic material, such as plastics or rubber, having a tubular body 22, an axial hole 20 surrounded by the tubular body 22, a mounting base 21 located on one end of the tubular body 22, a mounting hole 210 defined in the mounting base 21 in communication with the axial hole 20, a beveled abutment face 212 located on the outer side of the mounting base 21, a retaining portion 211 outwardly extended from the mounting base 21 around the mounting hole 210, and an end edge 221 located on the other end of the tubular body 22 remote from the mounting base 21 and extending around the axial hole 20.

The core tube 3 has an axial hole 30 axially extending through opposing front and rear sides thereof, a stop flange 31 extending around the periphery of the rear side thereof around the axial hole 30, a barbed flange 34 located on the front side thereof around the axial hole 30, a first tubular wall 322 and a second tubular wall 33 axially connected in series between the stop flange 31 and the barbed flange 34 around the axial hole 30 in a stepped manner, a hooked portion 321 extending around the periphery between the first tubular wall 322 and the second tubular wall 33, and a packing portion 32 connected between the second tubular wall 322 and the stop flange 31 around the axial hole 30.

The barrel 4 defines therein a coupling hole 40, having a tapered inner surface portion 41 located on the middle around the coupling hole 40, a hooked portion 43 disposed near one end thereof around the coupling hole 40 and a contracted inner wall portion 42 connected between the tapered inner surface portion 41 and the hooked portion 43 around the coupling hole 40.

During installation, fasten the mounting base 21 of the cylindrical casing 2 to the retaining portion 12 of the locknut 1 by forcing the retaining portion 211 of the cylindrical casing 2 into engagement with the stepped shoulder 121 of the retaining portion 12 of the locknut 1 to abut the beveled abutment face 212 of the mounting base 21 of the cylindrical casing 2 against the beveled abutment face 122 of the retaining portion 12 of the locknut 1. Subject to the design that the inner diameter of the retaining portion 12 of the locknut 1 is slightly smaller than the outer diameter of the mounting base 21 of the cylindrical casing 2, the stepped shoulder 121 of the retaining portion 12 of the locknut 1 effectively prohibits permeation of outside water after installation of the electrical signal connector in a coaxial cable and connection of the electrical signal connector with a matching external connector. After connection between the locknut 1 and the cylindrical casing 2, insert the core tube 3 into the center hole 10 of the locknut 1 and the axial hole 20 of the cylindrical casing 2 to engage the packing portion 32 of the core tube 3 into the mounting hole 210 of the cylindrical casing 2, keeping the stop flange 31 of the core tube 3 in the center hole 10 of the locknut 1 and the second tubular wall 322, first tubular wall 33 and barbed flange 34 of the core tube 3 in the axial hole 20 of the cylindrical casing 2. At this time, the outer end edge 341 of the barbed flange 34 of the core tube 3 is disposed adjacent to the end edge 21 of the tubular body 22 of the cylindrical casing 2. Thereafter, attach the barrel 4 to the cylindrical casing 2 to have the tubular body 22 of the cylindrical casing 2 be received in the coupling hole 40 of the barrel 4 and compressed by the tapered inner surface portion 41 and contracted inner wall portion 42 of the barrel 4 to deform, forming a neck portion 23. At this time, the hooked portion 43 of the barrel 4 engages the periphery of the tubular body 22 of the cylindrical casing 2 to prohibit separation between the cylindrical casing 2 and the barrel 4, and therefore the locknut 1, the cylindrical casing 2, the core tube 3 and the barrel 4 are firmly secured together.

Further, the packing portion 32 of the core tube 3 can be peripherally embossed to provide an embossed pattern that enhances connection tightness between the peripheral wall of the mounting hole 210 of the cylindrical casing 2 and the core tube 3. The embossed pattern can be formed of one or a number of endless ribs extending around the periphery of the packing portion 32 of the core tube 3, or a plurality of raised portions, protruding portions or hooked portions evenly distributed over the periphery of the packing portion 32 of the core tube 3. By means of changing the contact or engagement area between the packing portion 32 of the core tube 3 and the peripheral wall of the mounting hole 210 of the cylindrical casing 2, the connection tightness between the cylindrical casing 2 and the core tube 3 is controlled. Thus, when inserting a coaxial cable 5 into the axial hole 30 of the core tube 3 (see FIG. 5), the applied thrust force can force the packing portion 32 of the core tube 3 away from the peripheral wall of the mounting hole 210 of the cylindrical casing 2, allowing axial movement of the second tubular wall 322 of the core tube 3 in the mounting hole 210 of the cylindrical casing 2.

Figure 5:
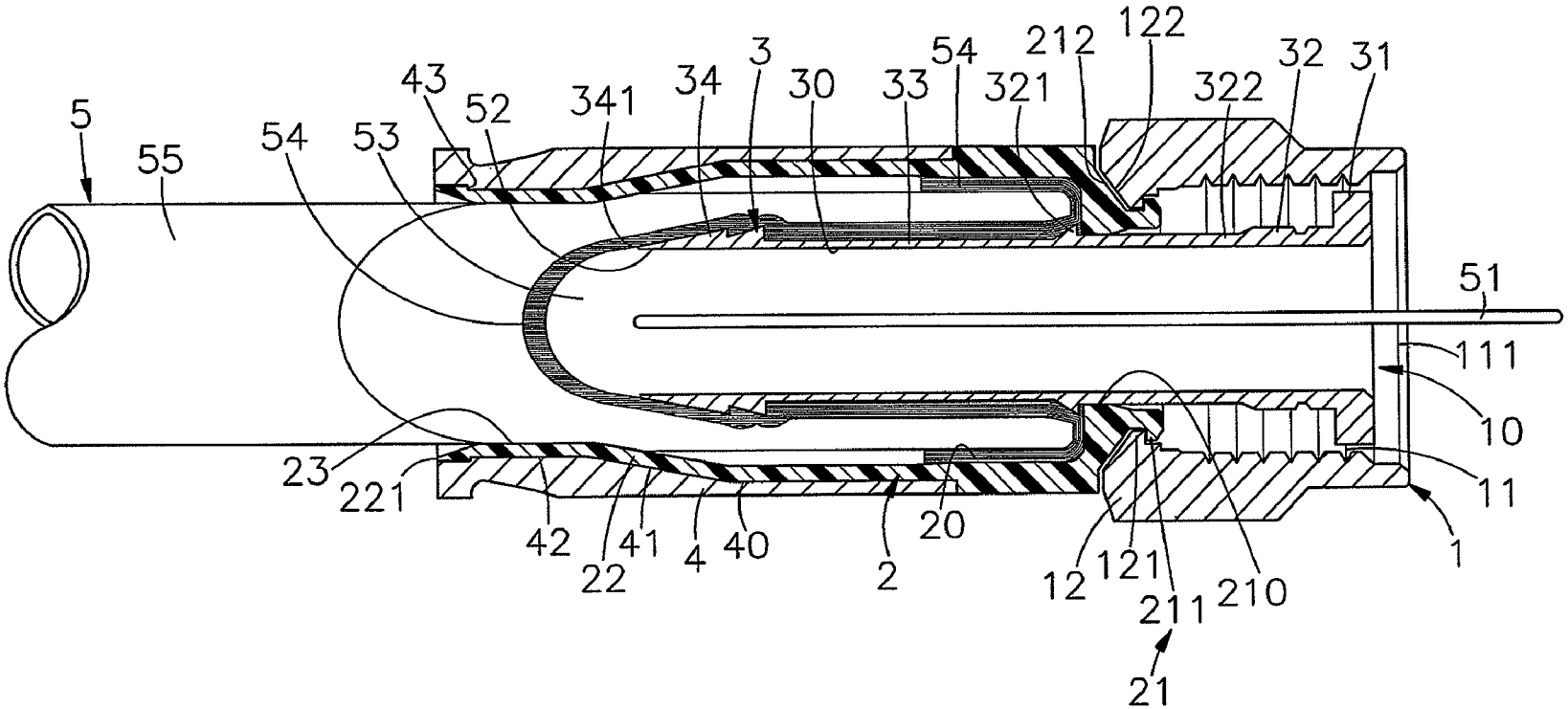
FIG. 5 is a schematic sectional view of the present invention, illustrating an electrical signal connector mounted on the coaxial cable before fixation.
Figure 6:
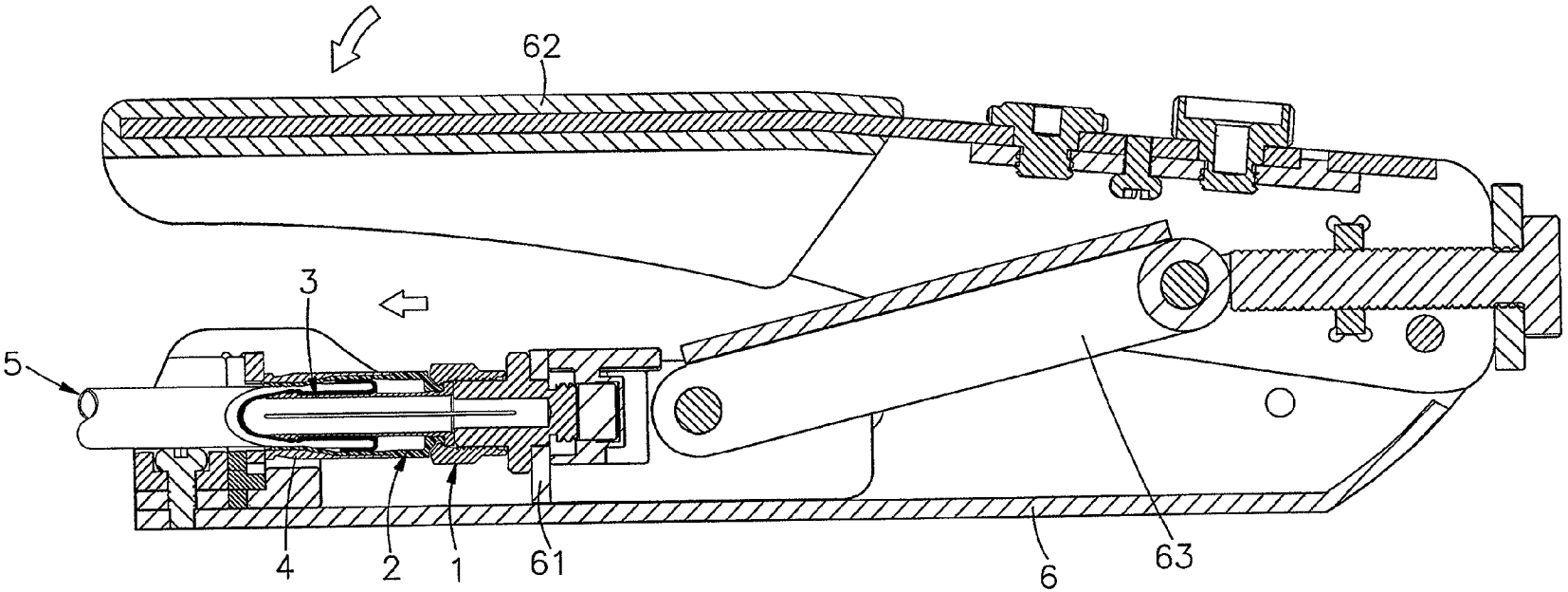
FIG. 6 is a schematic drawing illustrating the coaxial cable and the electrical signal connector put in a tool for fixation.
Figure 7:
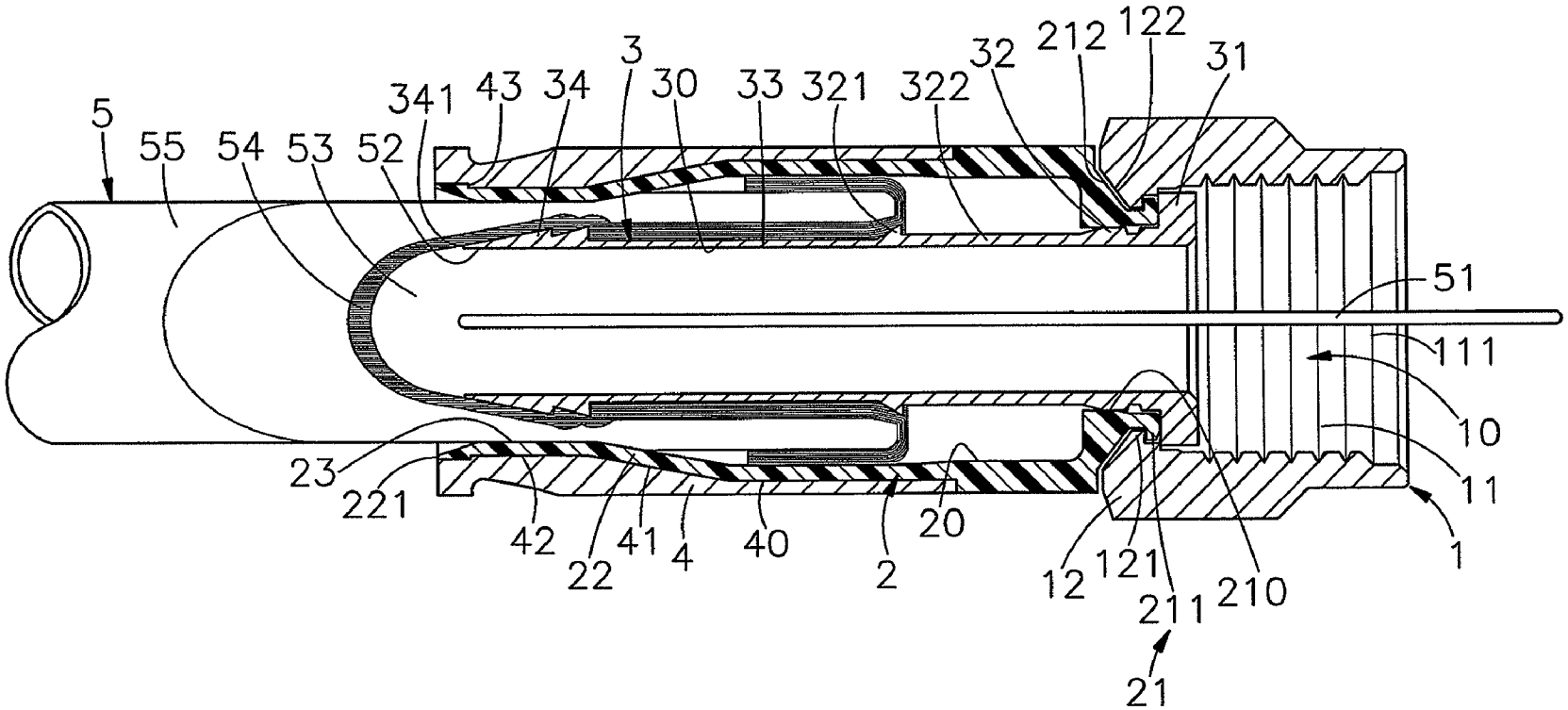
FIG. 7 is a sectional view of the present invention, illustrating the coaxial cable and the electrical signal connector fixedly fastened together.

Referring to FIGS. 5~7 and FIGS. 2 and 4 again, the electrical signal connector of the invention is to be used with a coaxial cable 5 that comprises an outer plastic sheath 55, a braided metal wrapper (woven copper shield) 54 surrounded by the outer plastic sheath 55, an inner dielectric insulator 53 surrounded by the braided metal wrapper (woven copper shield) 54, an aluminum foil shield 52 surrounded by the inner dielectric insulator 53 and a copper core (center conductor) 51 surrounded by the aluminum foil shield 52. The design of the neck portion 23 of the cylindrical casing 2 and the arrangement of the outer end edge 341 of the barbed flange 34 of the core tube 3. facilitate quick alignment of the coaxial cable 5. When fastening the electrical signal connector to the coaxial cable 5, insert the copper core (center conductor) 51, aluminum foil shield 52 and inner dielectric insulator 53 of the coaxial cable 5 into the axial hole 30 of the core tube 3 manually by hand to have the braided metal wrapper (woven copper shield) 54 and outer plastic sheath 55 of the coaxial cable 5 be sleeved onto the first tubular wall 33 and barbed flange 34 of the core tube 3. When pushing the coaxial cable 5 forwardly relative to the electrical signal connector, the packing portion 32 of the core tube 3 will be moved away from the mounting hole 210 of the mounting base 21 of the cylindrical casing 2, allowing axial movement of the second tubular wall 322 of the core tube 3 in the mounting hole 210 of the cylindrical casing 2. When the core tube 3 is being moved axially relative to the cylindrical casing 2 by the inserted coaxial cable 5, the hooked portion 321 will be stopped at the inner end of the mounting hole 210 of the mounting base 21 of the cylindrical casing 2, prohibiting falling of the core tube 3 out of the locknut 1. Thus, the coaxial cable 5 and the electrical signal connector are temporarily coupled together.

Thereafter, put the coaxial cable 5 and the electrical signal connector that are temporarily coupled together in a base member 61 of a tool 6, and then operate an operating handle 62 of the tool 6 to move a link 63 of the tool 6, moving the coaxial cable 5 and the core tube 3 into the center hole 10 of the locknut 1 and forcing the packing portion 32 into the mounting hole 210 of the mounting base 21 of the cylindrical casing 2. At this time, the braided metal wrapper (woven copper shield) 54 and outer plastic sheath 55 of the coaxial cable 5 are synchronously moved in the axial hole 20 of the cylindrical casing 2 and stopped by the neck portion 23 of the cylindrical casing 2, causing the barbed flange 34 of the core tube 3 to be engaged into the inside of the braided metal wrapper (woven copper shield) 54 of the coaxial cable 5. Thus, the coaxial cable 5 is firmly secured to the inside of the locknut 1, cylindrical casing 2, core tube 3 and barrel 4 of the electrical signal connector without causing deformation of the copper core (center conductor) 51 or damage to the aluminum foil shield 52. Therefore, the invention facilitates quick and accurate connection between the coaxial cable 5 and the electrical signal connector, assuring signal transmission stability and reliability and improving signal transmission quality.

Figure 8:
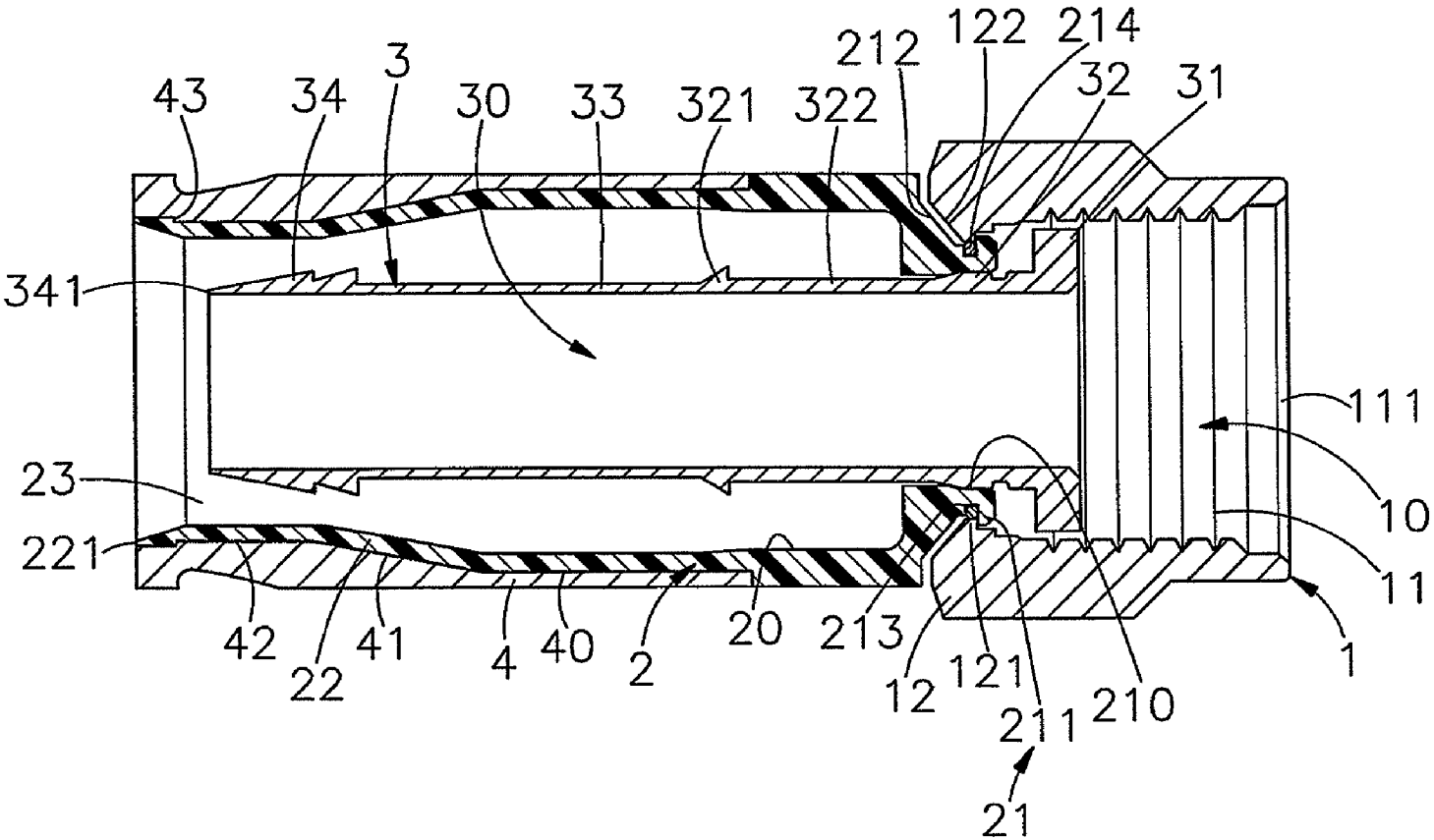
FIG. 8 is another sectional assembly view of the present invention, illustrating a gasket ring mounted in the locating groove of the mounting base of the cylindrical casing and stopped against the stepped shoulder of the retaining portion of the locknut.
Figure 9:
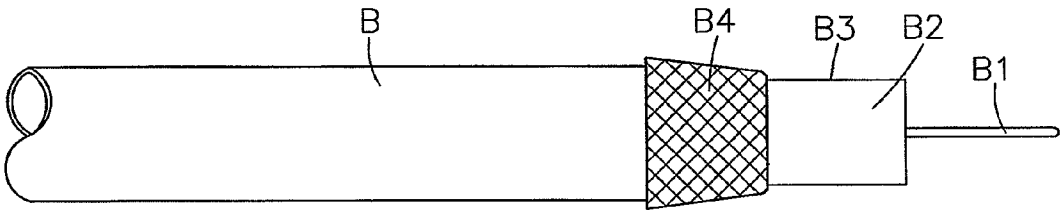
PRIOR ART FIG. 9
FIG. 9 is a side view of a conventional coaxial cable.
Figure 10:
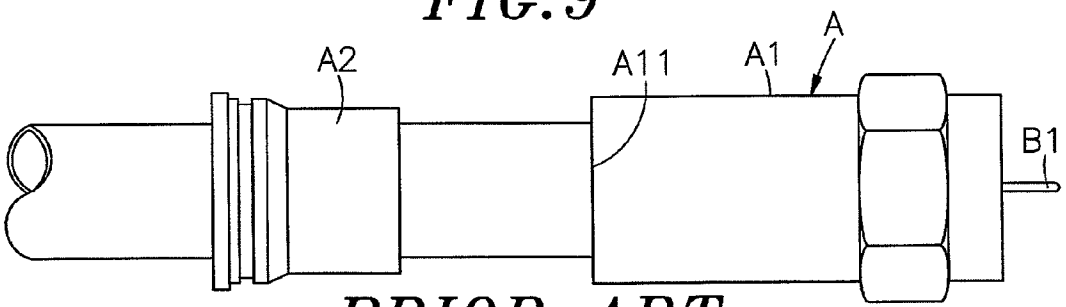
PRIOR ART FIG. 10
FIG. 10 is a schematic side view illustrating installation of a coaxial cable in an electrical signal connector according to the prior art.
Figure 11:
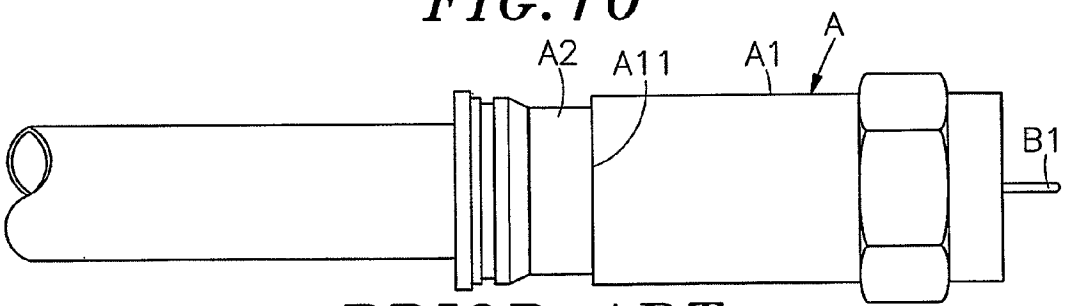
PRIOR ART FIG. 11
FIG. 11 corresponds to FIG. 10, illustrating the cable inserted into the crimping tube and casing of the electrical signal connector and the crimping tube fastened to the casing.
Figure 12:
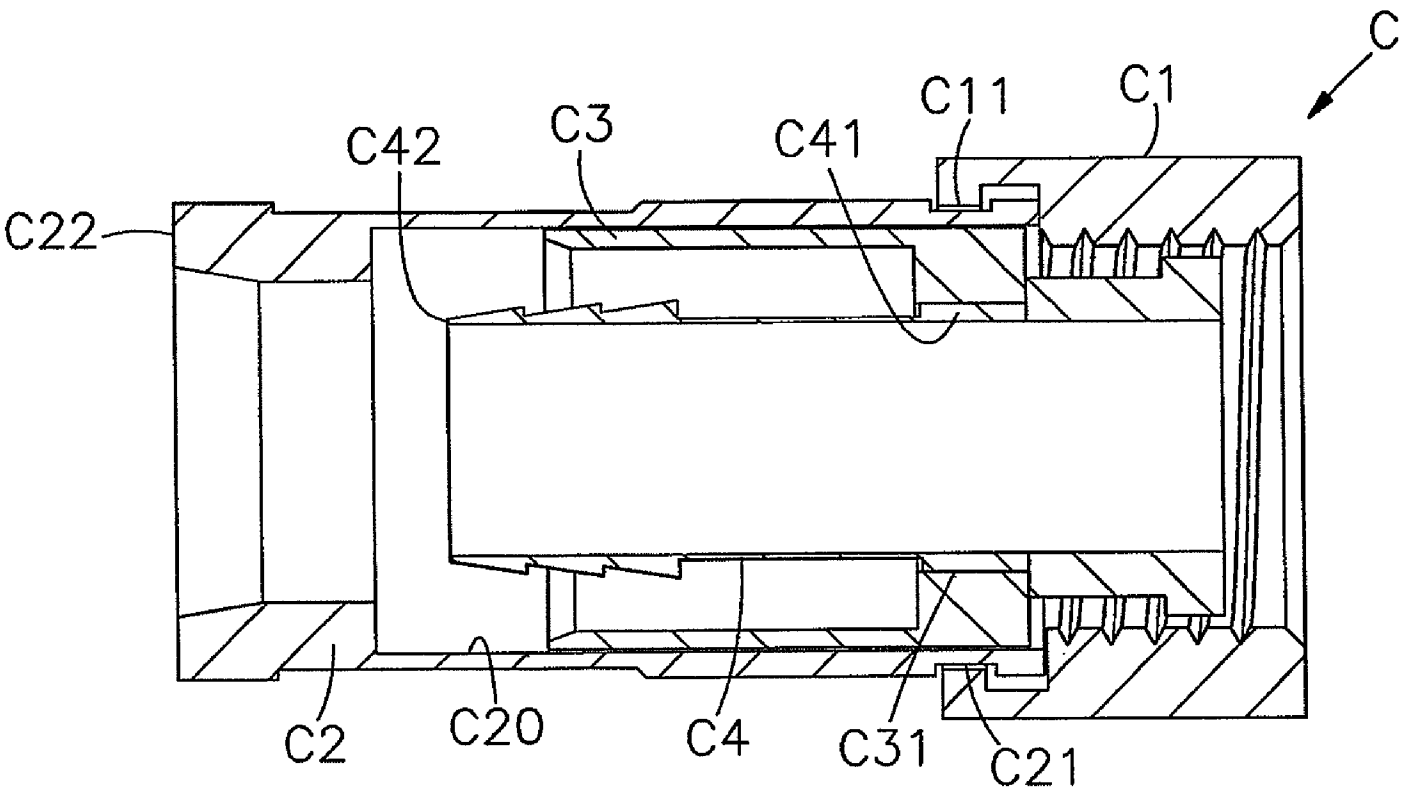
PRIOR ART FIG. 12
FIG. 12 is a sectional view of another structure of electrical signal connector according to the prior art.
Figure 13:
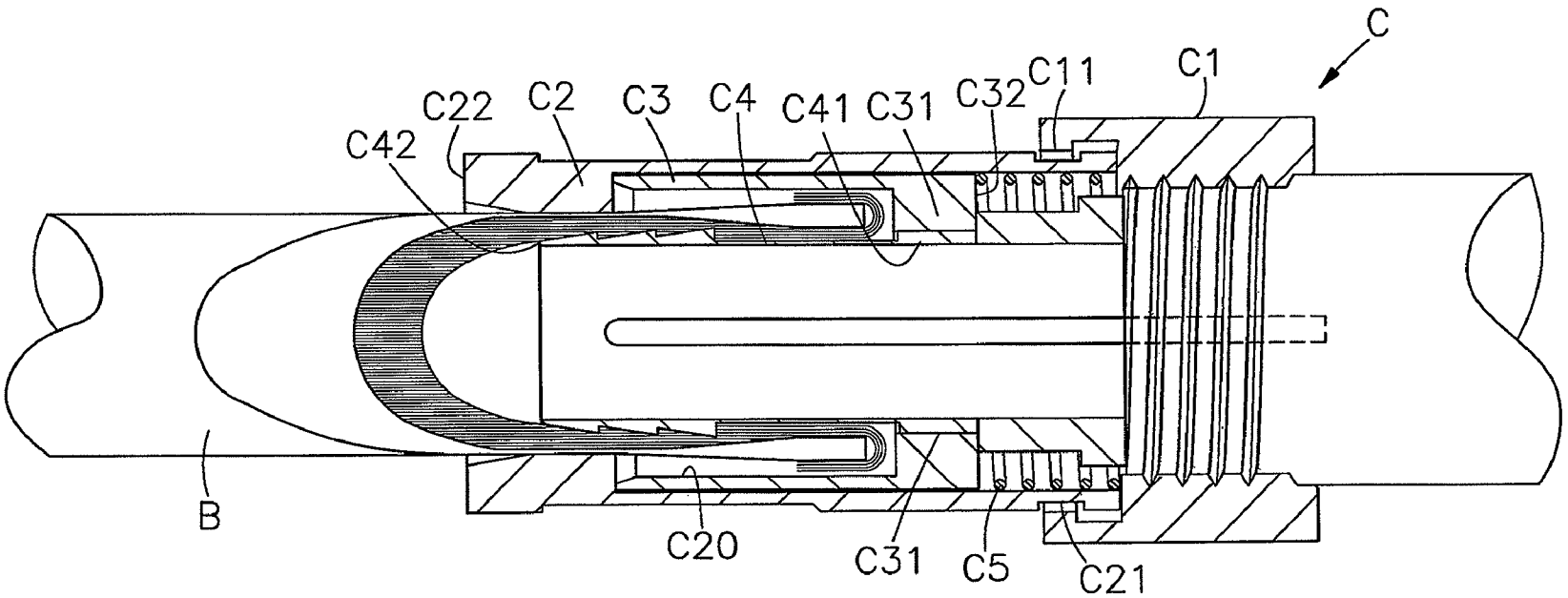
PRIOR ART FIG. 13
FIG. 13 is a schematic drawing illustrating the electrical signal connector of FIG. 12 connected to a coaxial cable
Figure 14:
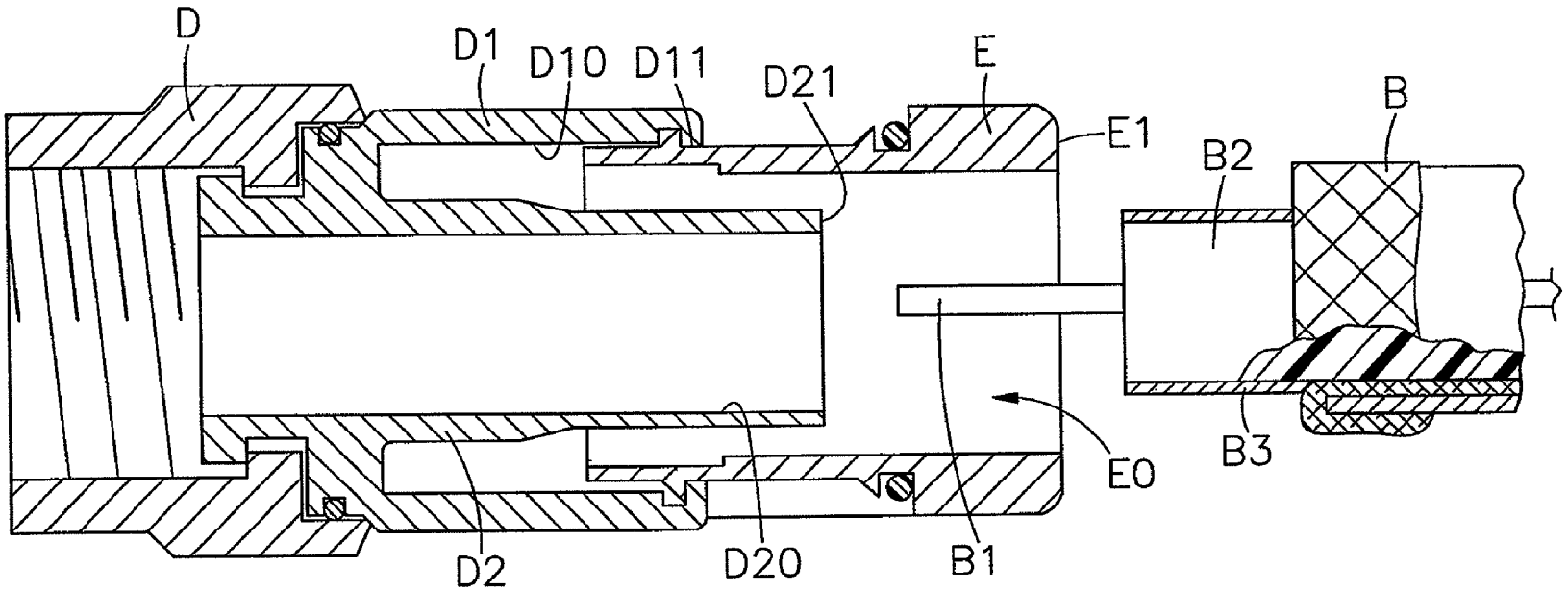
PRIOR ART FIG. 14
FIG. 14 illustrates a radial compression type coaxial cable end connector according to the prior art.
Figure 15:
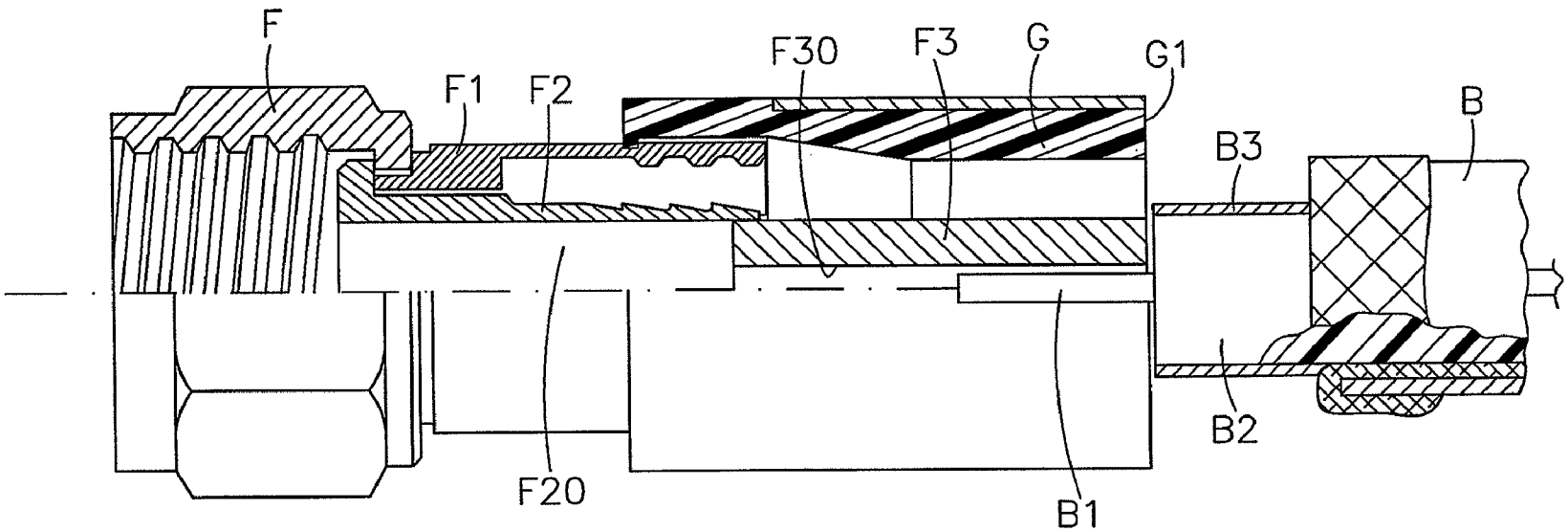
PRIOR ART FIG. 15
FIG. 15 is a schematic sectional view of still another design of coaxial cable connector according to the prior art.

Referring to FIG. 8 and FIGS. 2 and 4 again, the cylindrical casing 2 further comprises a locating groove 213 located on the mounting base 21 between the retaining portion 211 and the beveled abutment face 212. Further, a gasket ring 214 is mounted in the locating groove 213 of the mounting base 21 of the cylindrical casing 2 and stopped against the stepped shoulder 121 of the retaining portion 12 of the locknut 1 to seal the gap between the cylindrical casing 2 and the locknut 1, preventing water leakage.

It is to be understood that the above description is simply an example of the present invention and not intended as a limitation of the present invention. The invention is characterized in that the flexible cylindrical casing 2 is fastened to the retaining portion 12 of the locknut 1 to have the beveled abutment face 212 of the mounting base 21 of the cylindrical casing 2 be abutted against the beveled abutment face 122 of the retaining portion 12; the core tube 3 is inserted into the center hole 10 of the locknut 1 and the axial hole 20 of the cylindrical casing 2 to suspend the outer end edge 341 of the barbed flange 34 in the tubular body 22 of the cylindrical casing 2 near the end edge 221 of the cylindrical casing 2; the barrel 4 is mounted on the tubular body 22 of the cylindrical casing 2 to compress the tubular body 22, allowing quick and accurate installation of the coaxial cable 5; the design of the neck portion 23 of the cylindrical casing 2 and the arrangement of the outer end edge 341 of the barbed flange 34 of the core tube 3 facilitate quick alignment of the coaxial cable 5, enabling the coaxial cable 5 to be accurately inserted into the axial hole 20 of the cylindrical casing 2 and firmly secured to the electrical signal connector to assure signal transmission stability and reliability and without causing deformation of the copper core (center conductor) 51 or any damage to the aluminum foil shield 52.

In actual use, the electrical signal connector of the present invention has the following advantages:

1. The locknut 1 is made of metal; the cylindrical casing 2 is made of an elastic material; the inner diameter of the retaining portion 12 of the locknut 1 is slightly smaller than the outer diameter of the mounting base 21 of the cylindrical casing 2; when fastening the mounting base 21 of the cylindrical casing 2 to the retaining portion 12 of the locknut 1, the retaining portion 211 of the mounting base 21 of the cylindrical casing 2 is forced into engagement with the stepped shoulder 121 of retaining portion 12 of the locknut 1, and the stepped shoulder 121 will be compressed to seal the gap upon between the cylindrical casing 2 and the locknut 1 and to prevent water leakage upon installation of an external matching electrical connector.

2. The design of the neck portion 23 of the cylindrical casing 2 and the arrangement of the outer end edge 341 of the barbed flange 34 of the core tube 3 facilitate quick alignment of the coaxial cable 5, enabling the coaxial cable 5 to be accurately inserted into the axial hole 20 of the cylindrical casing 2 and firmly secured to the electrical signal connector to assure signal transmission stability and reliability and without causing deformation of the copper core (center conductor) 51 or any damage to the aluminum foil shield 52.

3. After installation of the barrel 4 in the cylindrical casing 2, the hooked portion 43 of the barrel 4 engages the periphery of the tubular body 22 of the cylindrical casing 2, and the tubular body 22 of the cylindrical casing 2 is received in the coupling hole 40 of the barrel 4 and compressed by the tapered inner surface portion 41 and contracted inner wall portion 42 of the barrel 4 to deform, forming a neck portion 23; after installation of the coaxial cable 5 in the axial hole 20 of the cylindrical casing 2, the neck portion 23 secures the coaxial cable 5 in place, assuring connection stability and avoiding disconnection of the coaxial cable 5 from the cylindrical casing 2.

4. The barbed flange 34 of the core tube 3 is suspending in the cylindrical casing 2 near the end edge 221 of the tubular body 22, facilitating alignment of the coaxial cable 5 during installation, and therefore the electrical signal connector and the coaxial cable 5 can be fastened together rapidly, saving much installation time and labor.

5. The barbed flange 34 of the core tube 3 is suspending in the cylindrical casing 2 near the end edge 221 of the tubular body 22, facilitating accurate alignment and quick installation of the coaxial cable 5. After installation, the electrical signal connector and the coaxial cable 5 are firmly secured together, assuring signal transmission stability and reliability.

In conclusion, the invention provides an electrical signal connector consisting of a locknut, a cylindrical casing, a core tube and a barrel. The flexible cylindrical casing is fastened to a retaining portion of the locknut to have a beveled abutment face of a mounting base of the cylindrical casing be abutted against a beveled abutment face of a retaining portion in one end of the locknut; the core tube is inserted into the locknut and the cylindrical casing to suspend an outer end edge of a barbed flange of the core tube in the tubular body of the cylindrical casing near an end edge of the cylindrical casing; the barrel is mounted on the tubular body of the cylindrical casing to compress the tubular body, allowing quick and accurate installation of a coaxial cable without causing deformation of the copper core (center conductor) of the coaxial cable or any damage to the aluminum foil shield of the coaxial cable.

Although a particular embodiment of the invention has been described in detail for purposes of illustration, various modifications and enhancements may be made without departing from the spirit and scope of the invention. Accordingly, the invention is not to be limited except as by the appended claims.

What the invention claimed is:

1. An electrical signal connector, comprising:

a locknut made of metal, said locknut comprising a center hole axially extending through opposing front and rear sides thereof, an inner thread extending around an inside wall thereof within said center hole, an orifice defined in the rear side thereof in communication with one end of said center hole, and a retaining portion located on the front side thereof around said center hole;

a cylindrical casing made of an elastic material, said cylindrical casing comprising an axial hole, a mounting base located on one end thereof around said axial hole and adapted for fastening to the retaining portion of said locknut and a mounting hole defined in said mounting base in communication with said axial hole;

a core tube inserted into the center hole of said locknut and the axial hole of said cylindrical casing, said core tube comprising an axial hole extending through opposing front and rear sides thereof for receiving the center conductor and inner dielectric insulator of a coaxial cable, a barbed flange located on the front side around the axial hole thereof for engaging the braided metal wrapper of the coaxial cable, a first tubular wall axially connected between a stop flange and said barbed flange around the axial hole thereof, a packing portion connected between said first tubular wall and said stop flange around the axial hole thereof for engaging into the mounting hole of said mounting base of said cylindrical casing and a second tubular wall axially connected between said stop flange and said first tubular wall around the axial hole thereof, and a hooked portion extending around the periphery between said first tubular wall and said second tubular wall; and a barrel mounted on said cylindrical casing, said barrel comprising a coupling hole adapted for receiving said cylindrical casing, and a contracted inner wall portion adapted for compressing said cylindrical casing, wherein said locknut further comprises a beveled abutment face located on an outer side of said stepped shoulder; said cylindrical casing further comprises a beveled abutment face located on an outer side of said mounting base and abutted against the beveled abutment face of said locknut.

2. The electrical signal connector as claimed in claim 1, wherein the retaining portion of said locknut comprises a stepped shoulder extending around an opposite end of said center hole; said mounting base of said cylindrical casing comprises a retaining portion adapted for engaging said stepped shoulder of said locknut, a locating groove extending around the periphery thereof at one side of the retaining portion of said mounting base and a gasket ring mounted in said locating groove and stopped against said stepped shoulder.

3. The electrical signal connector as claimed in claim 1, wherein said locknut is selected from a material group consisting of copper, ferrite and metal alloys.

4. The electrical signal connector as claimed in claim 1, wherein said cylindrical casing is made of an elastic material selected from a material group consisting of elastic plastics and rubber.

* * * * *